US005425476A

United States Patent [19]

Montaner et al.

[11] Patent Number: 5,425,476

[45] Date of Patent: Jun. 20, 1995

[54] PUMP SPRAYER WITH STATIONARY DISCHARGE

[75] Inventors: Pedro P. Montaner, Esplugues de Llobregat; Victor R. Turró, Barcelona, both of Spain

[73] Assignee: Monturas S.A., Barcelona, Spain

[21] Appl. No.: 267,512

[22] Filed: Jun. 29, 1994

[51] Int. Cl.[6] ..... B67D 5/42

[52] U.S. Cl. ..... 222/383.1

[58] Field of Search ..... 222/321, 341, 382, 383, 222/385

[56] References Cited

U.S. PATENT DOCUMENTS

| | | | |
|---|---|---|---|
| 4,046,292 | 9/1977 | Corsette | 222/383 |
| 4,051,983 | 10/1977 | Anderson | 222/321 |
| 4,146,155 | 3/1979 | Kutik et al. | 222/385 X |
| 4,225,060 | 9/1980 | Kutik et al. | 222/380 X |
| 4,271,990 | 6/1981 | Kutik et al. | 222/321 |
| 4,306,670 | 12/1981 | Oshikubo | 222/383 X |
| 4,739,904 | 4/1988 | Spencer et al. | 222/383 X |
| 4,941,595 | 7/1990 | Montaner et al. | 222/321 |
| 5,064,105 | 11/1991 | Montaner | 222/321 |
| 5,181,635 | 1/1993 | Balderrama et al. | 222/383 |

FOREIGN PATENT DOCUMENTS

| | | | |
|---|---|---|---|
| 2634825 | 2/1990 | France | 222/383 |
| 5-229577 | 9/1993 | Japan | 222/383 |

*Primary Examiner*—Andres Kashnikow
*Assistant Examiner*—Kenneth Bomberg
*Attorney, Agent, or Firm*—Watson, Cole, Grindle & Watson

[57] ABSTRACT

A precompression pump sprayer having a stationary discharge is of compact construction while having separate springs for the plunger and valve member as well as pump priming and container venting features.

13 Claims, 2 Drawing Sheets

PUMP SPRAYER WITH STATIONARY DISCHARGE

RELATED APPLICATION

This application relates to application Ser. No. 08/267,513 filed on even date herewith, entitled PUMP SPRAYER WITH STATIONARY DISCHARGE, and commonly owned herewith.

BACKGROUND OF THE INVENTION

This invention relates generally to a pump sprayer of the precompression type, and is an improvement over the spray pump disclosed in our U.S. Pat. No. 4,941,595.

Normally, pump sprayers of the type to which the present invention is directed include a reciprocating pump plunger having a discharge passage terminating in a spray cup which reciprocates together with the plunger for dispensing product under pressure during each pressure stroke in which a sliding discharge valve is forced open in response to a build up of pressure in the pump chamber. Since the spray button reciprocates with the plunger, the spray path shifts relative to a fixed target.

The need arises for the provision of a fixed discharge such that the spray cup is stationary during plunger reciprocation to thereby more accurately fix the spray path to a fixed target during spraying.

Moreover, it is desirable to retain the benefits achieved by the U.S. Pat. No. 4,941,595 patented spray pump providing for separate springs for the pump plunger and the discharge valve in a precompression pump sprayer having a fixed discharge. Fewer molded parts for the pump are required thereby translating into reduced molding costs and assembly while enhancing the easy operation of the pump.

It is further desirable to provide a pump sprayer which is more compact than those known sprayers requiring a reciprocating spray cup, while at the same time providing for simple and easy fabrication and use of the pump having both pump priming and container venting features.

SUMMARY OF THE INVENTION

It is an object of the present invention to provide a precompression pump sprayer which avoids the aforenoted drawbacks, while retaining the advantages derived from such a sprayer of the U.S. Pat. No. 4,941,595 type suitable for a wide range of liquid viscosities and for a wide range of precompression values.

This objective is attained by the provision of a pump sprayer having a stationary discharge and of compact construction which is easy to operate, has a reduced number of molded parts and has container venting and pump priming features of simple construction, all of which renders the pump sprayer highly effective for its intended use.

DETAILED DESCRIPTION OF THE INVENTION

Figure 5:
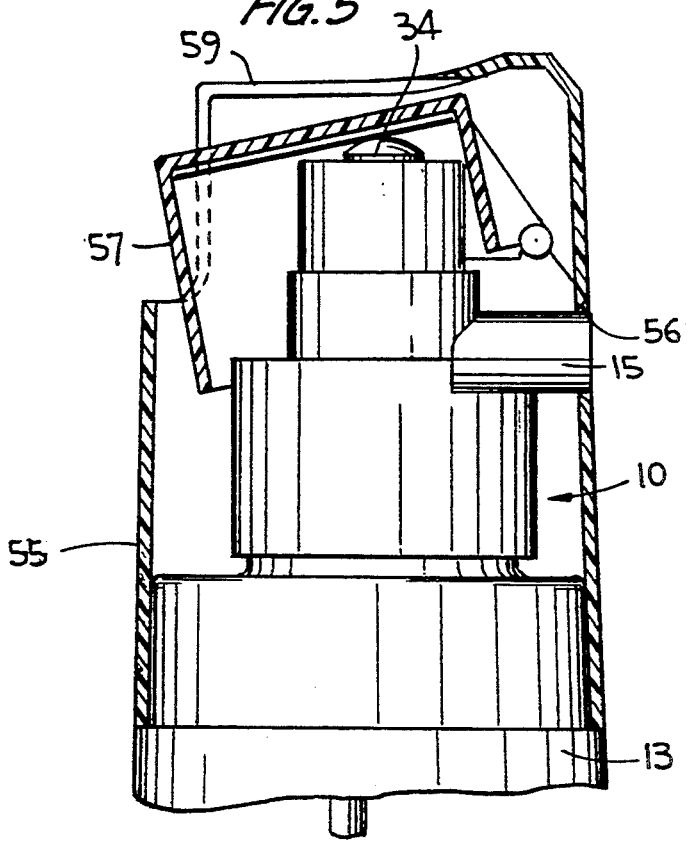
FIG. 5 is a view similar to FIG. 4 showing the plunger cap and plunger depressed during pumping and priming operations.

Turning now to the drawings wherein like reference characters refer to like and corresponding parts throughout the several views, the pump sprayer according to the invention is generally designated 10 throughout the several views, the sprayer having a pump housing 11 which includes an internally threaded closure 12 for mounting the sprayer to the neck of a container 13 partly shown in FIGS. 5, 6.

The pump housing includes a depending seal skirt 14 located within the closure for sealing engagement with the inner surface of the container neck when the pump is mounted in place. A discharge barrel or tube 15 extends transversely of the central axis of the closure and forms a discharge passage 16 terminating in a discharge orifice 17 located in a spray cup 18 fixed at the free end of the tube 15.

A discharge valve seat 19 opening into passage 16 and having an upper conical surface is formed at the inner end of passage 16 together with a portion of a sleeve 21 mounted within the housing which supports a dip tube 22 extending into the container. An inlet valve port forms a conical inlet valve seat 23 at its upper surface supporting an inlet ball check valve 24. An upper extension of sleeve 21 is formed as a pump cylinder 25 fixed within the pump housing, and a cup-shaped cover 26 fixed to the housing surrounds cylinder 25 in spaced relation to therewith define an annular gap 27. The cover has a central opening 28 bounded by a depending annular lip 29.

A pump plunger having a piston cup 31 is mounted within pump cylinder 25 for sliding sealing engagement via depending and upwardly extending, conical, annular piston seals 32 and 33. A plunger head or button 34 extends upwardly from the piston cup and projects through central opening 28 so as to extend a predetermined distance above upper wall 35 of cover 26.

Figure 1:
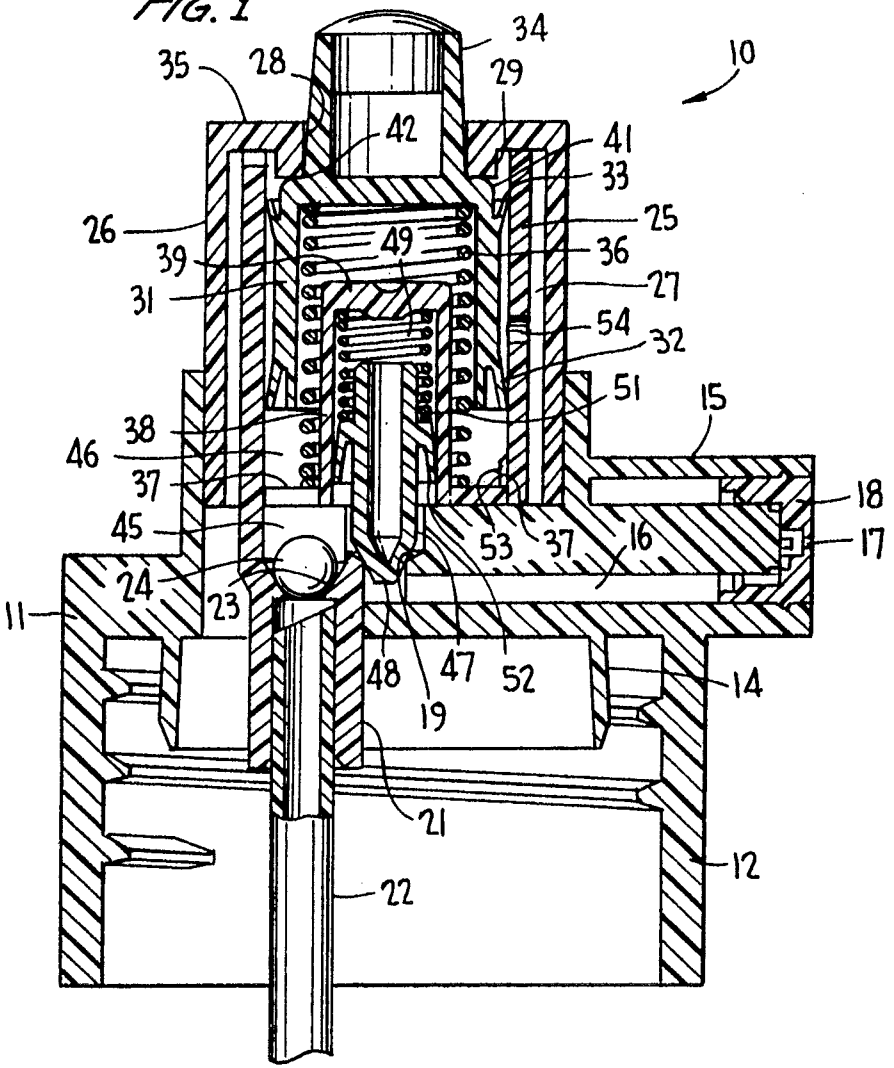
FIG. 1 is a vertical sectional view of the pump sprayer according to the invention showing the pump sprayer in its inactive position.

The plunger is spring biased into its inactive position of FIG. 1 by the provision of first spring means which may be in the form of a coil spring 36 extending between the underside of piston cup 31 and the upper face of support legs 37 forming part of an internal cylinder 38 having a closed upper end wall 39.

In the inactive position of FIG. 1, the piston cup, at its shoulder 41 formed between the piston cup and button 34, bears tightly against inner circular edge 42 of lip 29 thereby forming a container vent valve and valve seat.

Figure 2:
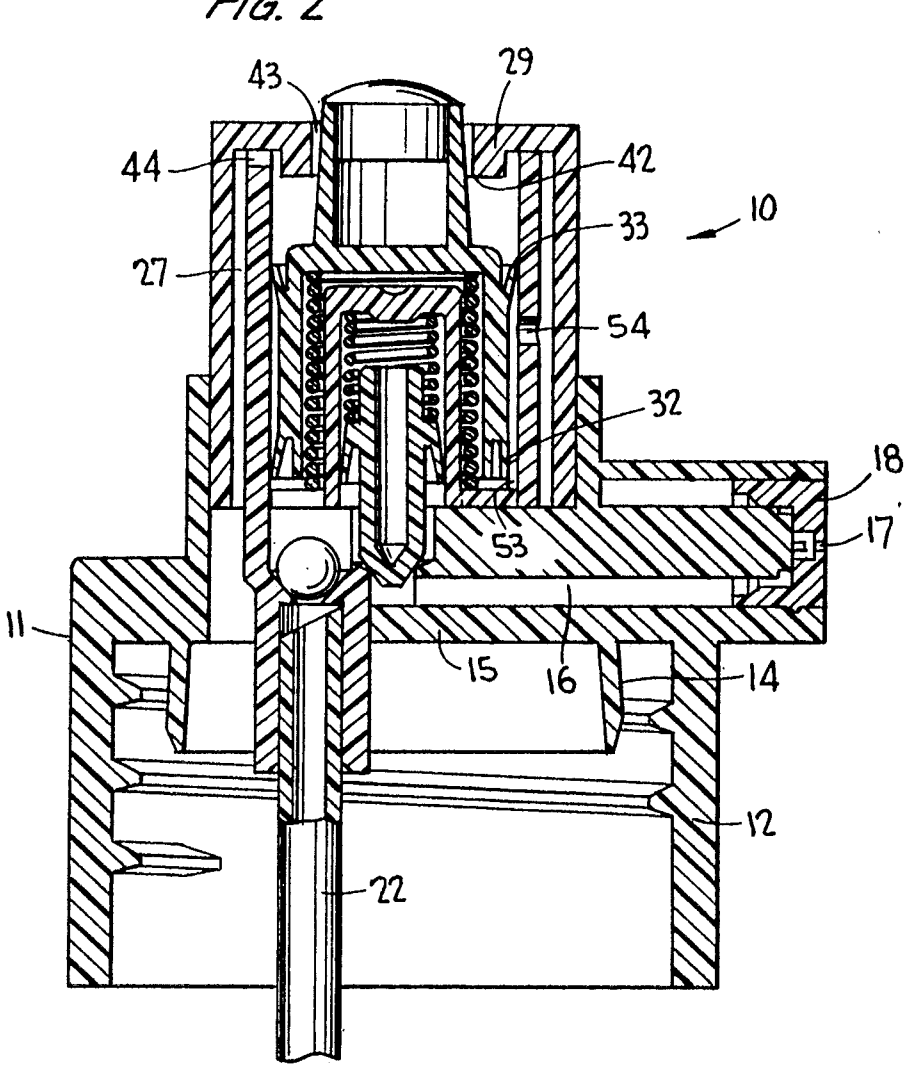
FIG. 2 is of view similar to FIG. 1 showing the pump plunger in its depressed position during pump priming.

Plunger button 34 may be of conical shape as shown so as to form an annular gap 43 (FIG. 2) upon plunger depression whereupon shoulder 41 of the piston cup is moved away from circular edge 42 permitting the entry of air during plunger reciprocation into the container via gap 27 and an opening 44 located in cylinder 25. Otherwise, the plunger button can be provided with one or more grooves or ribs (not shown) in its outer surface and be otherwise of cylindrical shape to establish an opening or openings for the passage of air during plunger depression to effect container venting.

Cylinder 38 is located within piston cup 31 and is fixed to the housing via its legs 37 which are circumferentially spaced apart about the periphery of cylinder 38. Cylinder 38 opens at its lower end into product inlet passage 45 which opens into a variable volume pump chamber 46 formed by pump piston 31 and pump cylinder 25.

A discharge valve member 47 in the form of a poppet valve forms a valve tip 48 at its lower end which is normally seated against valve seat 19 in the inactive position of FIG. 1. The valve member is spring biased into this position by the provision of second spring means which may be in the form of a coil spring 49 extending between the underside of wall 39 and a shoulder 51 extending laterally of the discharge valve and from which a conical valve seal 52 depends. The valve seal 52 is in sliding sealing engagement with the inner surface of cylinder 38 and provides an under bearing surface for effecting a shifting of the discharge valve to its open position in response to a build up of pressure in the pump chamber.

Seal 32 of the piston is resiliently deformable and coacts with a vertical rib 53 located within the pump chamber on the inner wall of cylinder 25. An opening 54 is located in pump cylinder 25 and straddles seals 32 and 33 on the piston in its inactive position, opening 54 communicating with gap 27 which opens into the container via closure 12.

Prior to the dispensing operation, it is assumed that the pump chamber 46 will contain air which must be evacuated from the pump to effect pump priming. As air is highly compressible during initial pumping insufficient pressure will build up in the pump chamber to open the discharge for evacuating the air.

The pump is effectively primed upon initial depression of the plunger as pump seal 32 coacts with priming rib 53 which thereby deforms seal 32 (shown in FIG. 2) allowing for the passage of air from the pump chamber through the interstices formed by deformed seal 32, through opening 54, gap 27 and into the container. Upon inward depression of the plunger, upper seal 33 remains located above port 54 to prevent any blow by of air which may be mixed with liquid beyond the upper end of the piston and through gap 43 which would cause leakage of the pump. The plunger may need to be downwardly stroked one or more times to completely evacuate the air from the pump chamber as the sealing action between seal 32 and the pump cylinder is broken by the provision of rib 53. It should be pointed out that in lieu of a rib 53 a vertical groove may instead be provided, or a grooved protuberance of the type disclosed in U.S. Pat. No. 5,064,105 may be provided, without departing from the invention.

After the pump is primed liquid is drawn through inlet passage 45 into the expanding pump chamber on each return stroke of the plunger, the liquid within the pump chamber is pressurized during each plunger downstroke, and the pressure acting against the underside of seal 52 of the discharge valve thereby causes the valve member to shift inwardly of its cylinder 38 whereupon valve tip 48 unseats permitting the discharge of product under pressure through discharge passage 16 and orifice 17. Upon a reduction of pressure in the pump chamber below that of the force of return spring 36, spring 36 returns the plunger to its inactive position of FIG. 1 whereupon the pump chamber is again filled with product through the valved inlet passage on each ensuing upstroke of the plunger. During each pumping downstroke, the seal between button 34 and lip 29 is broken such that air is permitted to enter the container via gap 43, opening 44, and gap 27, to replace the volume of product dispensed to avoid hydraulic lock and container collapse.

Figure 4:
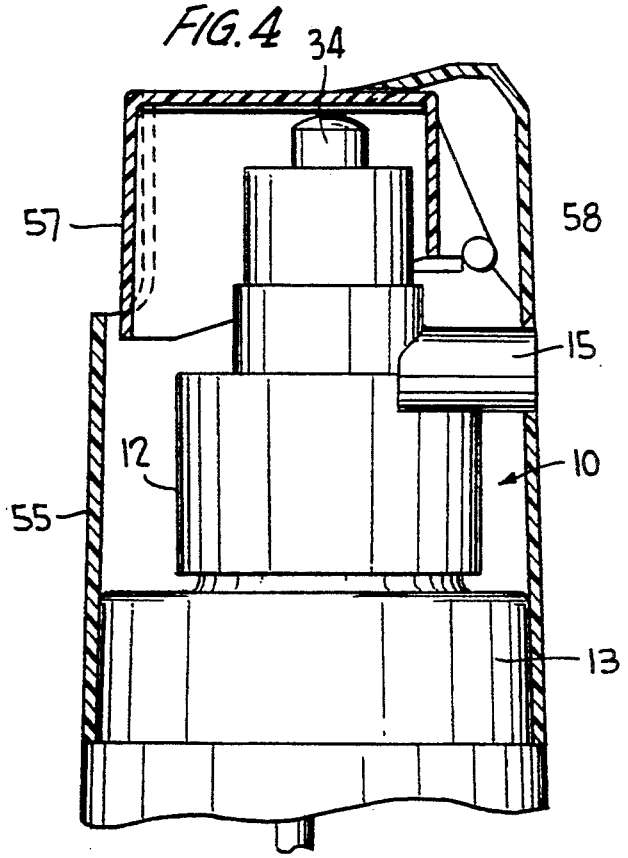
FIG. 4 is a side elevational view of the FIG. 1 pump sprayer shown mounted on the neck of a container partly shown, and a shroud cover and plunger cap shown in section.
Figure 3:
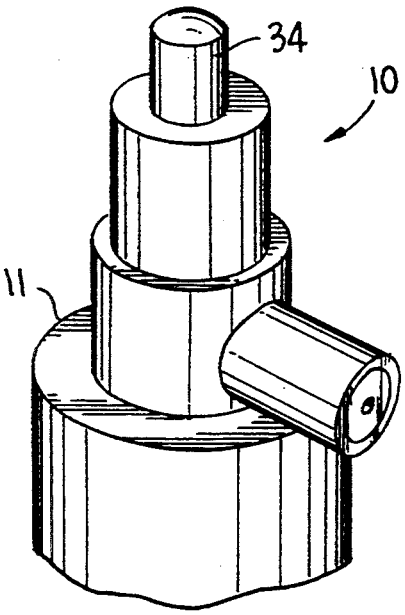
FIG. 3 is a perspective view of the FIG. 1 pump sprayer.

The pump sprayer may be covered by a shroud 55 which, as shown in FIGS. 4, 5, is fixed to container 13 and has a side opening 56 in alignment with discharge tube 15.

A plunger cap 57 is hingedly mounted to the pump housing as at 58 and extends through a cut-out 59 located in the shroud. The underside of the plunger cap bears against the top of plunger button 34 such that upon application of finger pressure applied to the cap in the direction of the arrow of FIG. 5, the cap pivots about its hinge and transmits finger depression to the plunger via its head 34.

What is claimed is:

1. A pump sprayer comprising: a pump housing; a pump cylinder within said housing; a pump piston reciprocable within said cylinder between inactive and downstroke positions to therewith define a variable volume pump chamber; first spring means urging said piston to said inactive position; a valve controlled inlet passage in communication with a source of liquid to be dispensed leading into said pump chamber; a valve controlled discharge passage having a valve seat leading from said pump chamber; a second cylinder within said pump cylinder; a discharge valve member mounted for sliding movement within said second cylinder between a first position in engagement with said valve seat and a second position out of engagement with said valve seat, second spring means urging said valve member to said first position, the improvement wherein said second cylinder is fixedly mounted within said pump cylinder and has a closed upper end and an open bottom end, and wherein said valve controlled discharge passage is fixedly mounted within said housing and extends laterally from said pump chamber.

2. The pump sprayer according to claim 1, wherein said discharge valve member comprises a poppet valve having an end movable into and out of engagement with said valve seat for controlling the discharge.

3. The pump sprayer according to claim 1, wherein said piston has an extension forming a plunger head protruding outwardly of said cylinder.

4. The pump sprayer according to claim 3, wherein a plunger cap is hingedly mounted on said housing and overlies said plunger head for transmitting to said pump piston an external finger force applied to said cap.

5. The pump sprayer according to claim 3, wherein a cup-shaped cover fixedly mounted on said housing surrounds said pump cylinder and has a lip in engagement with said piston for retaining said piston within said housing, said cover having a central opening through which said plunger head extends.

6. The pump sprayer according to claim 5, wherein said housing has means establishing a vent passage extending from within said housing through said central opening.

7. The pump sprayer according to claim 6, wherein vent passage means includes an opening located in said pump cylinder.

8. The pump sprayer according to claim 7, wherein said piston has a shoulder forming a valve seat in engagement with said lip for controlling the opening and closing of said vent passage during piston reciprocation.

9. The pump sprayer according to claim 1, further comprising means within said pump chamber cooperating with said piston near the end of the downward stroke thereof for decompressing said pump chamber.

10. The pump sprayer according to claim 9, wherein a cup-shaped cover fixedly mounted on said housing surrounds said cylinder in spaced relation to define an annular gap opening into the interior of said housing, said cylinder having a port opening into said gap to permit flow of entrapped air from said pump chamber upon decompression thereof.

11. A pump sprayer comprising: a pump housing; a pump cylinder within said housing; a pump piston reciprocable within said cylinder between inactive and downstroke positions to therewith define a variable volume pump chamber; first spring means urging said piston to said inactive position; a valve controlled inlet passage in communication with a source of liquid to be dispensed leading into said pump chamber; a valve controlled discharge passage having a valve seat leading from said pump chamber; a second cylinder within said pump cylinder; a discharge valve member mounted for sliding movement within said second cylinder between a first position in engagement with said valve seat and a second position out of engagement with said valve seat, second spring means urging said valve member to said first position, the improvement wherein said second cylinder is located within said piston and has a closed upper end and an open bottom end, and wherein said valve controlled discharge passage is fixedly mounted within said housing and extends laterally from said pump chamber.

12. The pump sprayer according to claim 11, wherein said discharge valve member comprises a poppet valve having an end movable into and out of engagement with said valve seat for controlling the discharge.

13. The pump sprayer according to claim 11, wherein said piston has an extension forming a plunger head protruding outwardly of said cylinder.

* * * * *